US006299474B2

(12) United States Patent
Daoud

(10) Patent No.: US 6,299,474 B2
(45) **Date of Patent: *Oct. 9, 2001**

(54) FRONT ACCESS CONNECTOR FOR MULTIPLE WIRE GAUGE AND WIRE WRAP CONNECTIONS

(75) Inventor: Bassel Hage Daoud, Parsipanny, NJ (US)

(73) Assignee: Avaya Technology Corp., Basking Ridge, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/397,900

(22) Filed: Sep. 17, 1999

(51) Int. Cl.[7] ..... H01R 11/20
(52) U.S. Cl. ..... 439/409; 439/395
(58) Field of Search ..... 439/409, 410, 439/411, 412, 413, 417, 426, 431, 432, 443, 391, 395, 400, 402, 404, 864, 725

(56) References Cited

U.S. PATENT DOCUMENTS 4,157,208 * 6/1979 Roberts et al. ..... 439/410
4,913,659 4/1990 Doyle ..... 439/395
5,240,432 8/1993 Daoud ..... 439/417
5,470,250 * 11/1995 Hawk et al. ..... 439/409
5,871,378 * 2/1999 Poiraud et al. ..... 439/676

* cited by examiner

*Primary Examiner*—Gary Paumen
*Assistant Examiner*—Ross Gushi
(74) *Attorney, Agent, or Firm*—Darby & Darby

(57) ABSTRACT

A high-density connector establishes electrical connections between insulated wires and other wires. The connector has terminals made of electrically conductive materials, for a plurality of insulated wires and a corresponding connector cap which has a round shape. The connector also has a base on which the terminals and cap are positioned. Each insulated wire has an insulation jacket. The connector includes front facing holes through which the insulated wires can be inserted. The terminals of the connector include a plurality of keyholes, each keyhole having a tail and a round portion that serves as the clearance hole for an insulated wire as it passes therethrough along with its insulation jacket. As the connector cap is rotated, it pushes the insulated wire placed in the round portion of the keyhole into the tail of the keyhole, which cuts into and removes the insulation jacket of the wire, thereby effecting an electrical connection between the electrical conductors of the wire and the terminals ofthe connector. The keyholes are adapted with particular tail widths to accommodate insulated wires of various gauge sizes. The connector can also effect electrical connection for a plurality of insulated wire.

23 Claims, 10 Drawing Sheets

FRONT ACCESS CONNECTOR FOR MULTIPLE WIRE GAUGE AND WIRE WRAP CONNECTIONS

FIELD OF THE INVENTION

The present invention relates generally to connectors for making electrical connection between insulated wires and other wires. In particular, the present invention relates to connectors with front facing insertion holes which are adapted to perform electrical connections on multiple wires of different gauge sizes.

BACKGROUND OF THE INVENTION

Connectors are available in the art for connecting insulated wires with other wires (insulated or uninsulated). A method of making electrical connections between insulated wires with others is to remove the insulation jacket, using pliers, with strippers or other tools, and expose the electrical conductors for direct electrical contact with another wire. Such a method is inefficient for making a large number of electrical connections because it is time-consuming and labor-intensive.

Connectors have been developed in the art for making electrical connections without using tools. These connectors are designed with internal structures that have the ability to remove the insulation jacket of an insulated wire without utilizing tools such as pliers. One such connector is disclosed in U.S. Pat. No. 5,240,432, entitled "Insulation Displacement Connectors" and having the same inventorship as the present invention. An electrical connector is provided therein which has a terminal for an insulated wire. The insulated wire has an insulation jacket, where electrical conductors are disposed at least partly in such jacket. The electrical conductor has a portion that is connectable to a wire and a cap that is initially seatable in an up position on the insulation jacket. The electrical connector is designed to allow the insertion of the insulated wire into a space enclosed by the cap and the insulation jacket. The cap is adapted to be forcibly pushed down from the up position onto the insulation jacket so as to effect an electrical connection with the insulated wire in the space enclosed by the cap.

A particular disadvantage of connectors in the art (such as the connector disclosed herein above) is that multiple wires cannot be simultaneously accommodated, since each wire needs to be inserted into a connector one-by-one. A further disadvantage is that multiple wires of different gauge sizes cannot be accommodated in the prior connector. A general need therefore exists in the art for a connector that can accommodate multiple wires in making electrical connections. Furthermore, a connector is needed to provide electrical connections for multiple wires of different gauge sizes.

SUMMARY OF THE INVENTION

The present invention provides a high-density connector for making electrical connections between insulated wires and other wires. The connector according to the present invention has terminals, which are made of electroconductive materials, for a plurality of insulated wires and a corresponding connector cap which has a round shape. The connector also has a base on which the terminals and cap are positioned. Each insulated wire has an insulation jacket. The connector includes front facing holes through which the insulated wires can be inserted. The terminals of the connector include a plurality of keyholes, each keyhole having a tail and a round portion that serves as the clearance hole for an insulated wire as it passes therethrough along with its insulation jacket. As the connector cap is rotated, it pushes an insulated wire placed in the round portion of a keyhole to the tail of the keyhole, which cuts into and removes the insulation jacket of the wire, thereby effecting an electrical connection between the electrical conductors of the wire and the terminals of the connector. The keyholes are adapted with particular tail widths to accommodate insulated wires of various gauge sizes. The connector ofthe present invention can also effect electrical connection for a plurality of insulated wires.

The present invention is advantageous because it can effect electrical connections for multiple insulated wires. A further advantage is that the connector of the present invention can accommodate a plurality of insulated wires of various gauge sizes. Another advantage is that the connector of the present invention, by virtue of its "L" shape tails, allows multiple wire wrap connections to its base. Yet another advantage of the present invention is that the round design of the connector and the cap minimizes the materials needed for, and cost of, fabrication.

BRIEF DESCRIPTION OF THE DRAWINGS

Other features and advantages of the present invention will be apparent from the following detailed description when read in conjunction with the accompanying drawings, in which like reference designations represent like features throughout the enumerated Figures. The drawings referred to herein will be understood as not being drawn to scale, except if specifically noted, the emphasis instead being placed upon illustrating the principles according to the present invention. In the accompanying drawings.

DETAILED DESCRIPTION OF THE PREFERRED EMBODIMENTS

Figure 1:
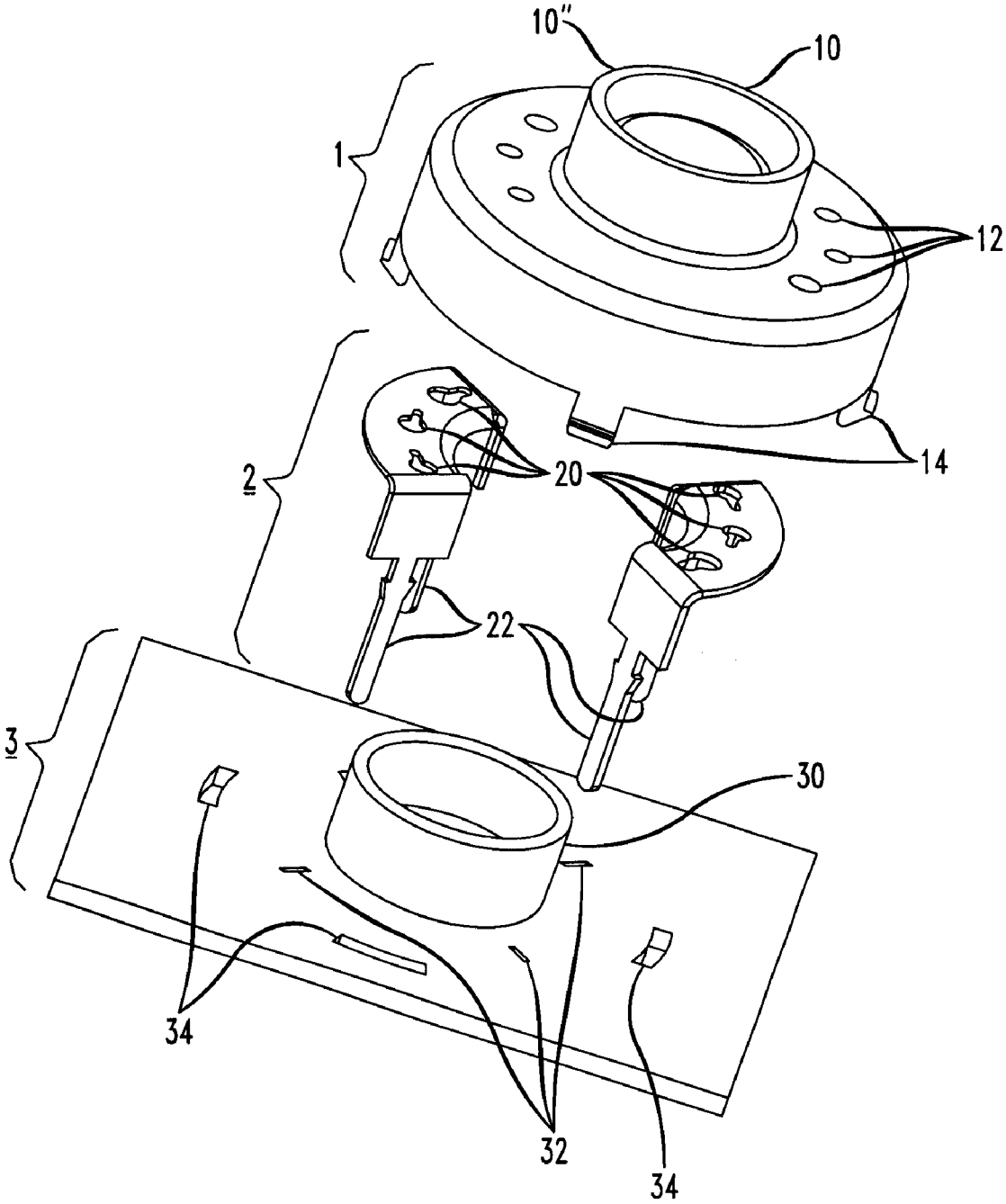
FIG. 1 is an exploded perspective view of an exemplary embodiment of a connector according to the present invention.

FIG. 1 is a diagram illustrating the components of a connector according to the present invention. Referring to FIG. 1, the connector includes a cap 1, twin terminals 2, and a base 3. The twin terminals 2 are made of electrically conductive materials, e.g., metals. Cap 1 and base 3 are made of non-electrically-conductive materials, e.g., plastics. Cap 1, which has a round shape, can be rotated and is adapted to receive twin terminals 2 and to allow insulated wires to pass through cap holes 12 and the round portions of keyholes 20 located on the twin terminals 2.

Cap 1, twin terminals 2, and base 3 can be pushed together to collapse into a single mechanical unit. When Cap 1 is pushed down against base 3, a downwardly extending circular portion 10' to cap notch 10, Cap 1 is securely received in base notch 30 (which also has a round shape), with twin terminals 2 disposed therebetween. Cap 1 can be securely fastened to base 3 by pushing cap hooks 14 through base grooves 34 so as to hook onto the bottom of base 3. Twin terminals 2 are secured onto base 3 by pushing L-shaped tails 22 through terminal slits 32 in the base 3 and hooking onto the bottom of base 3.

Figure 2:
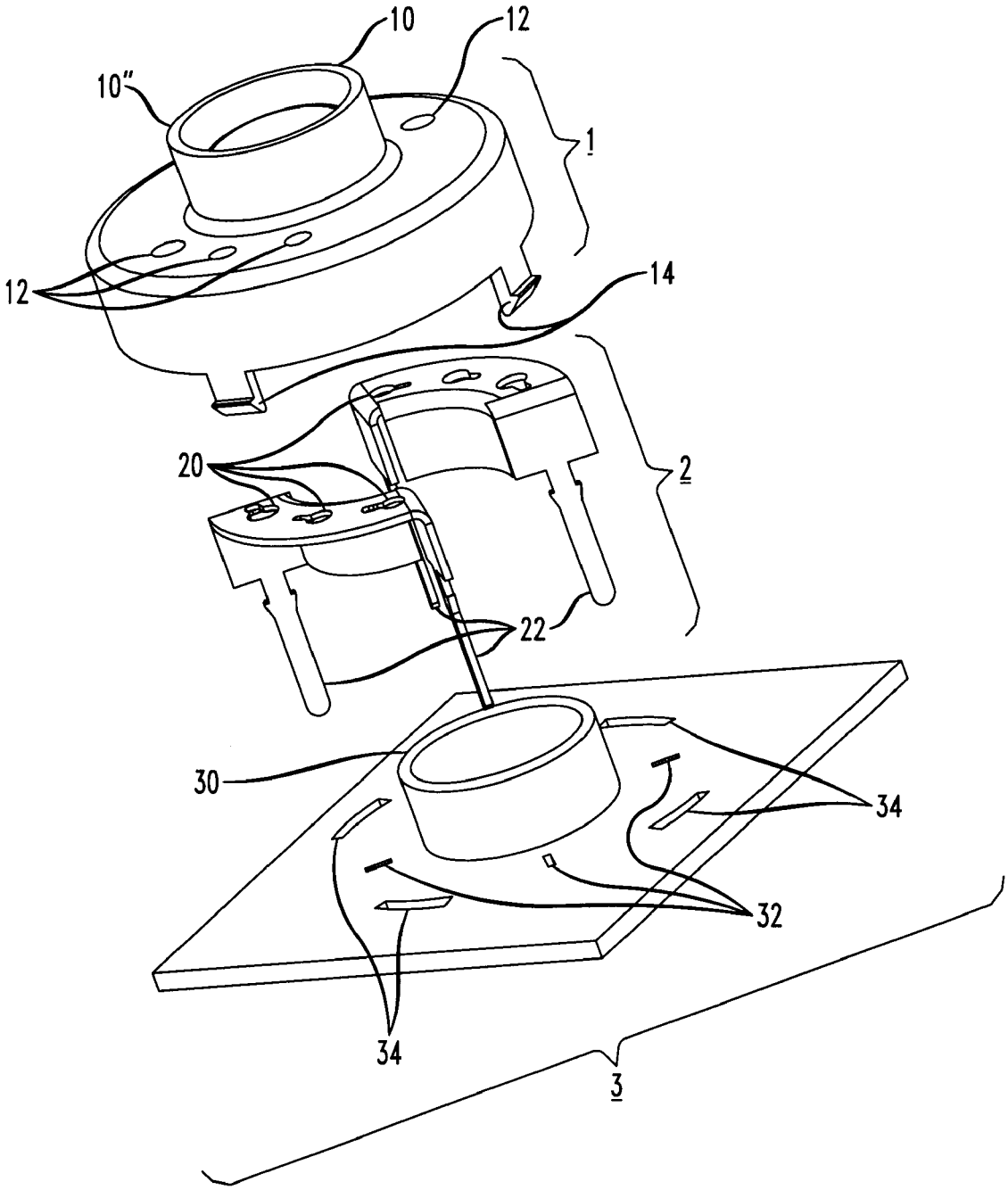
FIG. 2 is another exploded perspective view of the connector according to the present invention.

FIG. 2 is a diagram showing another angular view of the connector according to the present invention. Cap 1, twin terminals 2, base 3 and their respective components are similarly shown in FIG. 2.

Figure 3:
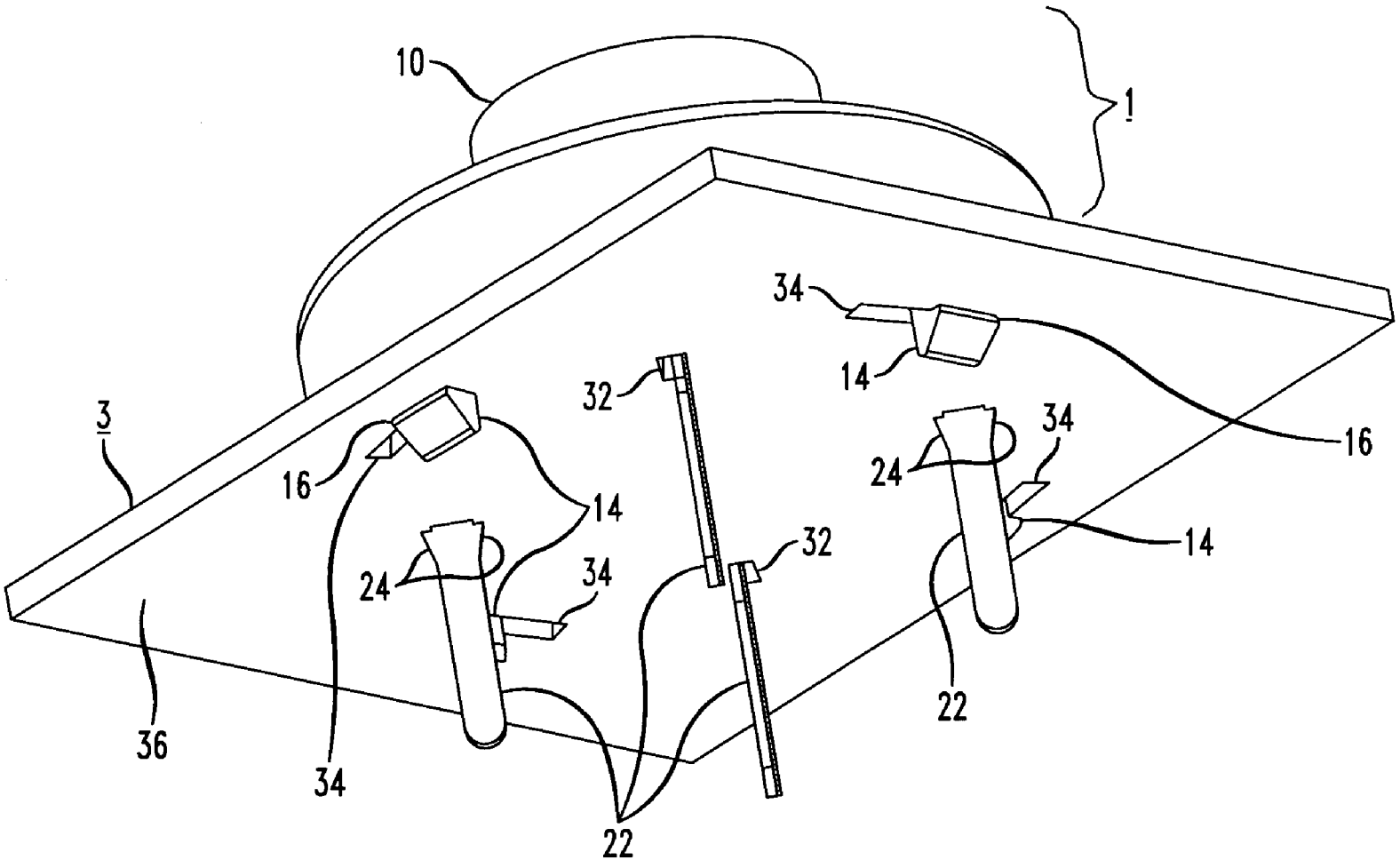
FIG. 3 is a perspective diagram of the connector according to the present invention when the cap, twin terminals and the base thereof are pushed together to form a single mechanical unit.

FIG. 3 is a diagram illustrating the bottom of the connector of the present invention when cap 1, twin terminals 2 and base 3 are pushed together into a single mechanical unit. Referring to FIG. 3, cap 1 has been pushed together with base 3, with twin terminals 2 disposed therebetween. However, twin terminals 2 are not seen in this perspective view, except for L-shaped tails 22 thereof. Base 1 is securely fastened onto base 3 by pushing cap hooks 14 through base grooves 34. This is facilitated by the compressible shape of the cap hook protrusion 16 at the ends of the hooks 16, which allow them to compress when they pull through grooves 34 and then extend to hook onto the bottom of base 3 to provide a retaining force for the cap 1 on the base 3. Similarly, L-shaped tails 22 and L-shaped tail protrusions 24 (FIG. 9B) are proportioned so that they can pass through terminal slits 32 and the tail protrusions 24 can hook onto the bottom of base 3. However, in this preferred embodiment since the base 3 is made of plastics, the slits 32 can expand to accommodate the tail protrusions 24 as they pull through. (FIG. 9C).

Base grooves 34 serve as the angular rotational stop for cap hooks 14 so that cap 1 can be rotated by twisting an upwardly extending portion 10" of cap notch 10 to an "aligned" position, i.e., a point where cap hooks 14, along with cap hook protrusions 16, are stopped by base grooves 34. The purpose for this is described below.

Figure 4:
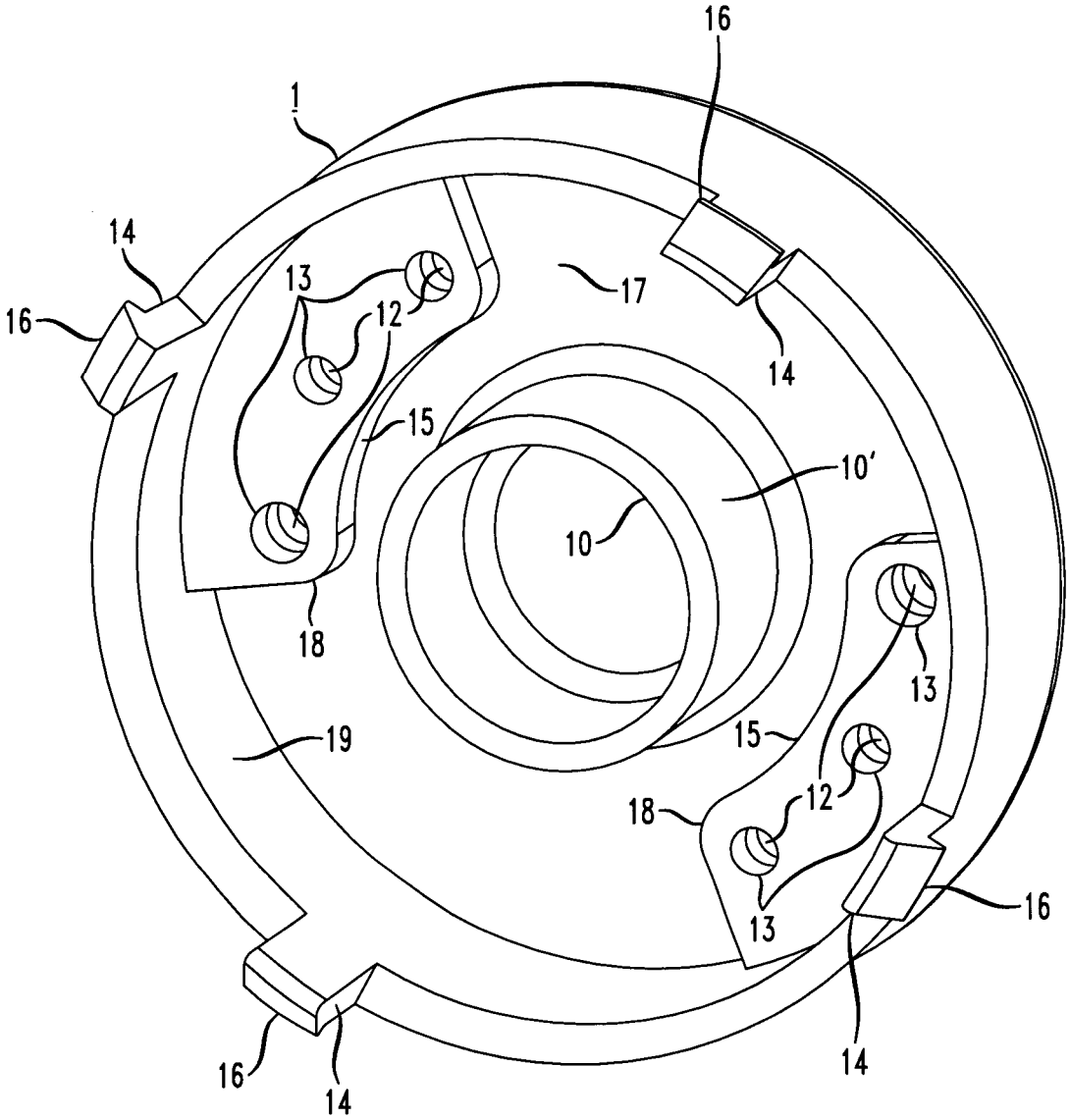
FIG. 4 is a diagram of another perspective view of the cap of the connector according to the present invention.

FIG. 4 is a diagram of another angular perspective view of cap 1 of the connector according to the present invention. In FIG. 4, the downward extension of cap notch 10 is seen, along with cap holes 12, cap hooks 14 with cap hook protrusions 16, and cap fins 18 with cap fin ends 15. The cap outside surface defines the cap holes 12. Further, FIG. 4 illustrates the location of cap inside holes 13 defined by cap fins 18, cap inside wall 19 and cap inside surface 17. Viewing the bottom of cap 1, cap fins 18 receive twin terminals 2. Cap holes 12 and cap inside holes 13, both of similar size, allow passage of insulated wires from the top of cap 1 through cap fins 18. Cap fins 18 are permanently affixed to cap inside wall 19. Spacing A between the cap inside upper surface 17 and the cap fins 18 (FIG. 9A) is formed such that the cap can be fastened with twin terminals 2 by fitting the top of twin terminals 2 into the spacing (FIG. 9C).

Figure 5:
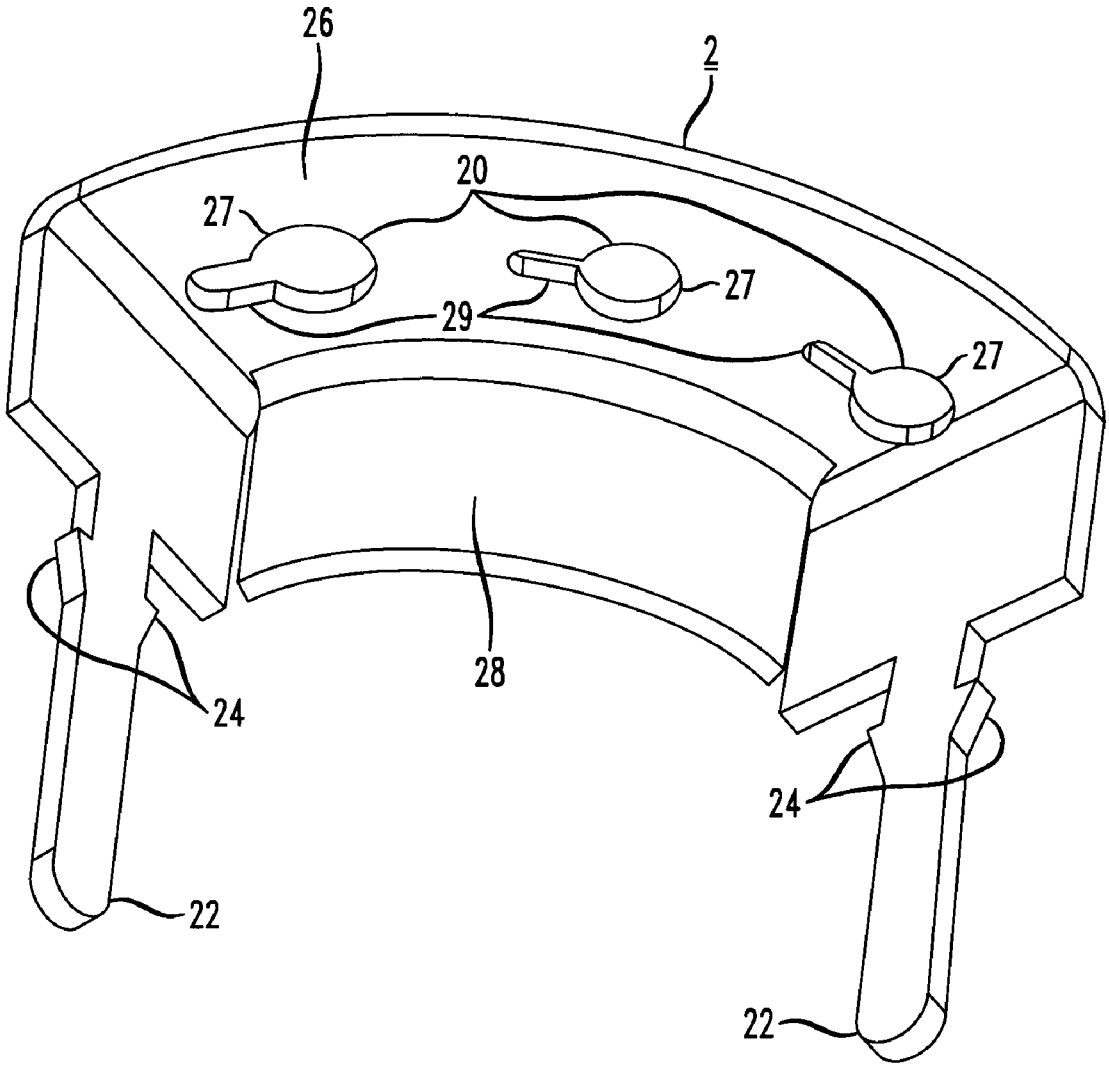
FIG. 5 is a diagram of another perspective view of one ofthe twin terminals of the connector according to the present invention.

FIG. 5 is a diagram of another angular perspective view of one of the two twin terminals 2 ofthe connector according to the present invention. Both terminals of twin terminals 2 are substantially identical. In FIG. 5, it is shown that one of the twin terminal 2 includes three keyholes 20, each with keyhole tails 29 and keyhole round portions 27 and formed in terminal top surface 26. A terminal side surface 28 extends perpendicular to top surface 26. The two terminals also include L-shaped tails 22 with L-shaped tail protrusions 24.

Keyhole round portions 27 are approximately the same size as cap holes 12 and cap inside holes 13 of cap 1. Each ofthe keyhole tails 29 are dimensioned such that they are only large enough to permit the electrical conductors of an insulated wire (not shown) to pass through. Each of keyhole tails 29 is not large enough to permit passage of the insulated wire with its insulation jacket. The upper rectangular portions of twin terminals 2 are dimensioned such that they can be fastened with cap 1 by sliding terminal top surface 26 into the space between cap fins 18 and cap inside surface 17. (FIG. 9C). Terminal side surface 28, which is concave-shaped, is disposed between cap fin ends 15 of cap fins 18 and the downwardly extending cap notch 10' (FIG. 4) when the twin terminals 2 are fastened with cap 1.

Figure 6:
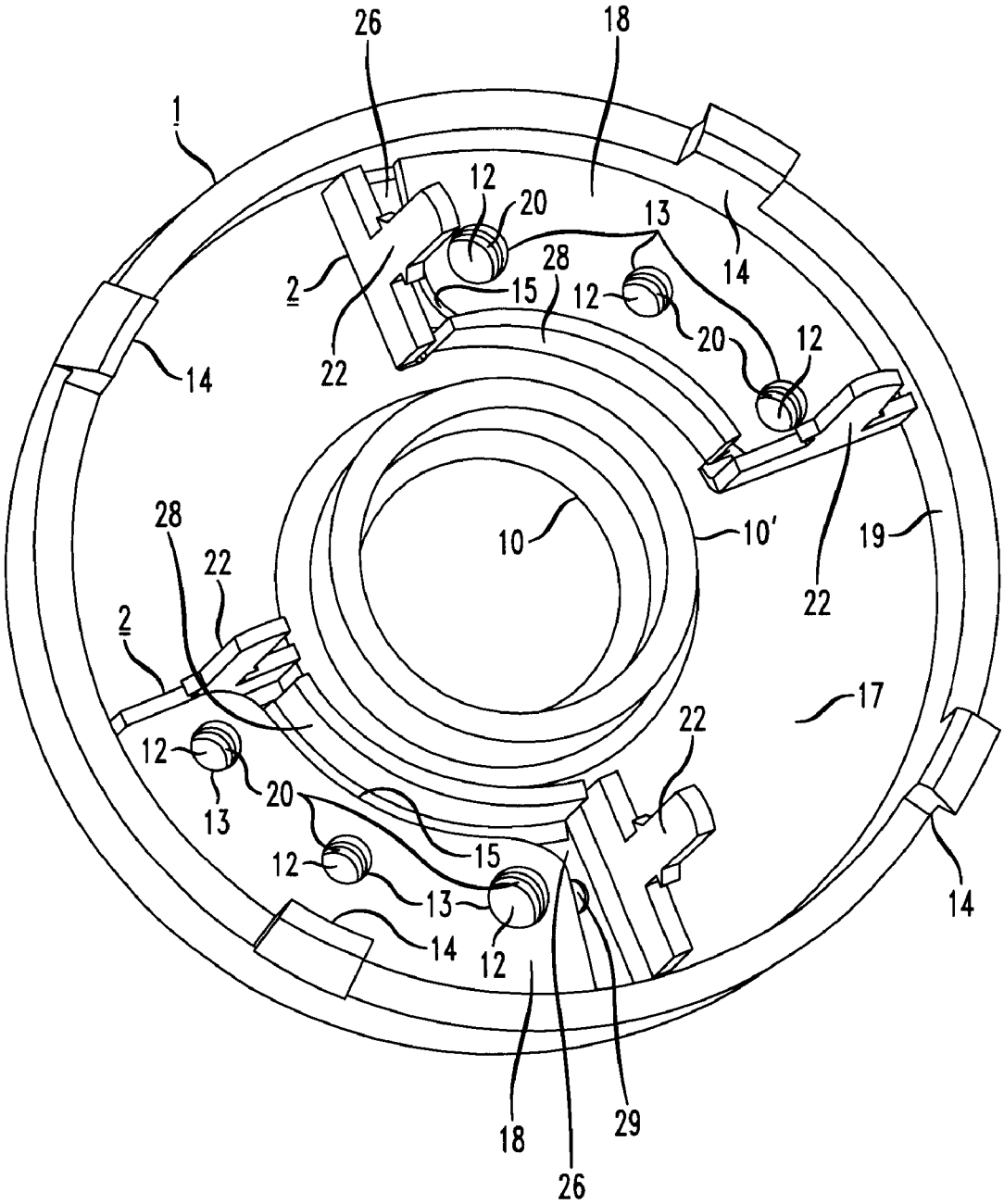
FIG. 6 is a diagram of a perspective view of the cap and the twin terminals of the connector according to the present invention when they are in the fastened position.

FIG. 6 is a diagram of cap 1 and twin terminals 2 of the connector according to the present invention, when they are fastened together. Referring to the figure, twin terminals 2 are fastened with cap 1 by positioning terminal top surface 26 into the space between cap fins 18 and cap inside surface 17 of cap 1. Terminal side surface 28 is disposed between lower cap notch 10' and cap fin ends 15 of cap fins 18. Cap 1 and twin terminals 2, as shown in FIG. 6, are in the so-called "aligned" position. Cap 1 and twin terminals 2, in the aligned position, have cap holes 12, keyhole round portions 27 of keyholes 20, and cap inside holes 13 aligned such that insulated wires (not shown) can pass through them. Each of the round openings created by cap holes 12, keyhole round portions 27, and cap inside holes 13 allows an insulated wire, along with its insulation jacket, to pass therethrough.

Figure 7:
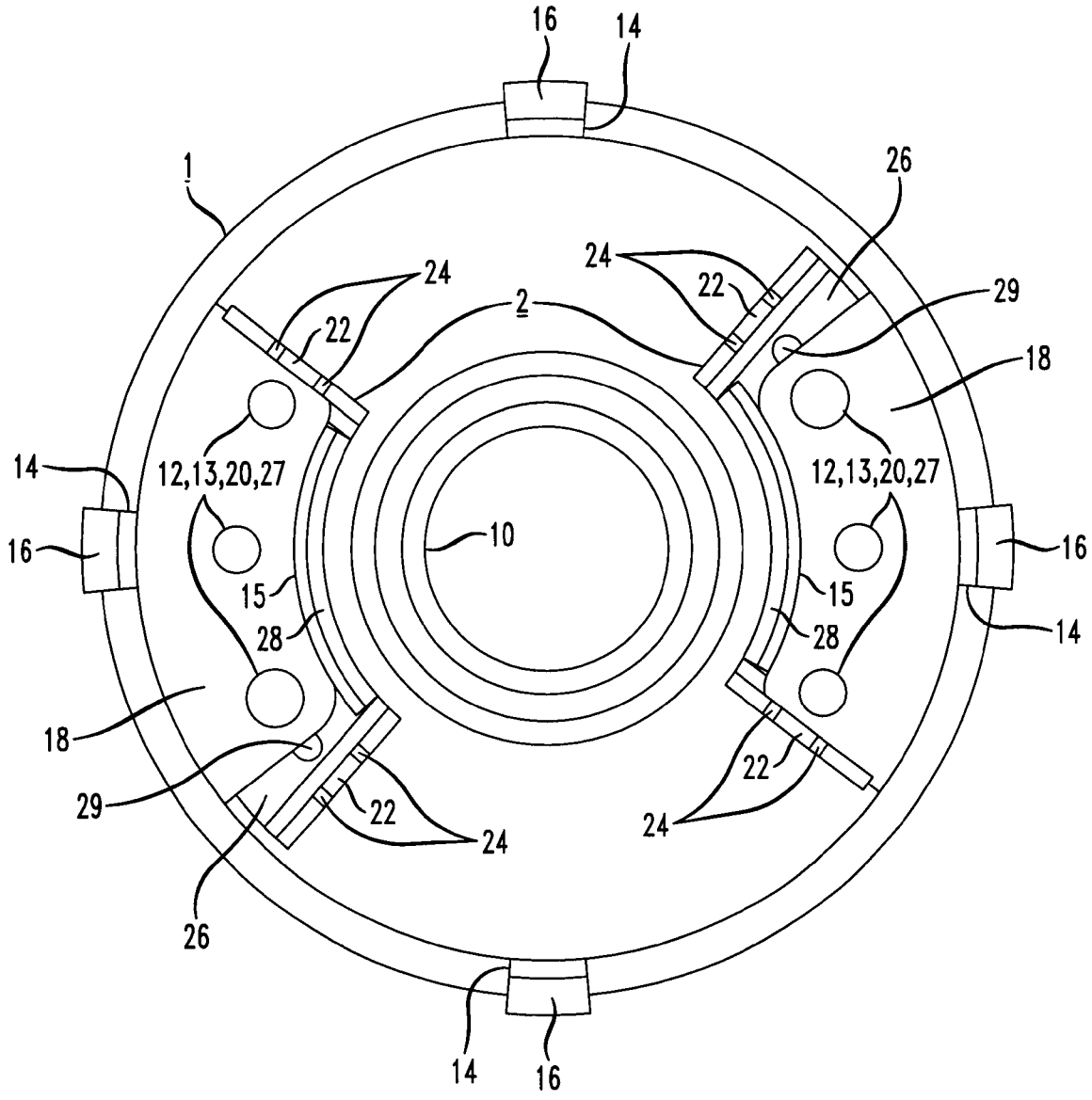
FIG. 7 is a diagram of a plan view of the cap and the twin terminals of the connector according to the present invention when they are in the fastened position.

FIG. 7 shows another view of cap 1 and twin terminals 2 in the aligned position. In this view, it can be seen that terminal side wall 28 and L-shaped tails 22 of twin terminals 2 hug cap fins 18 of cap 1, with terminal side wall 28 disposed between cap notch 10' and cap fin ends 15. The terminal top surface 26 is larger than cap fins 18 such that keyhole tails 29 can be aligned with cap holes 12 and cap inside holes 13.

Cap 1 and twin terminals 2 can switch from the aligned position to the non-aligned position by rotating cap 1. A user of the connector according to the present invention can rotate cap 1 by twisting cap notch portion 10". As cap 1 is rotated, it pushes the insulated wires placed in keyhole round portions 27, which are aligned with cap holes 12 and cap inside holes 13 in the aligned position, to keyhole tails 29, which are aligned with cap holes 12 and cap inside holes 13 in the non-aligned position. During the transition from the aligned position to the non-aligned position, keyhole tails 29 cut into and remove the insulation jacket from the insulated wires. As the insulation jacket of the insulated wires is removed, the electrical conductors of the insulated wires are exposed. Since twin terminals 2 are made of electrically conductive materials, an electrical connection is effected between the conductors of the insulated wires and the twin terminals 2.

Keyhole tails 29 can be adapted with particular widths to accommodate insulated wires of various gauge sizes. Since there are multiple cap holes 12 for receiving multiple insulated wires, the connector according to the present invention can advantageously effect an electrical connection for a plurality of insulated wires simultaneously, merely by twisting cap 1. Furthermore, L-shaped tails 22 of twin terminals 2 permit multiple wire wrap connections so that additional connections to a circuit can be easily made.

Figure 8:
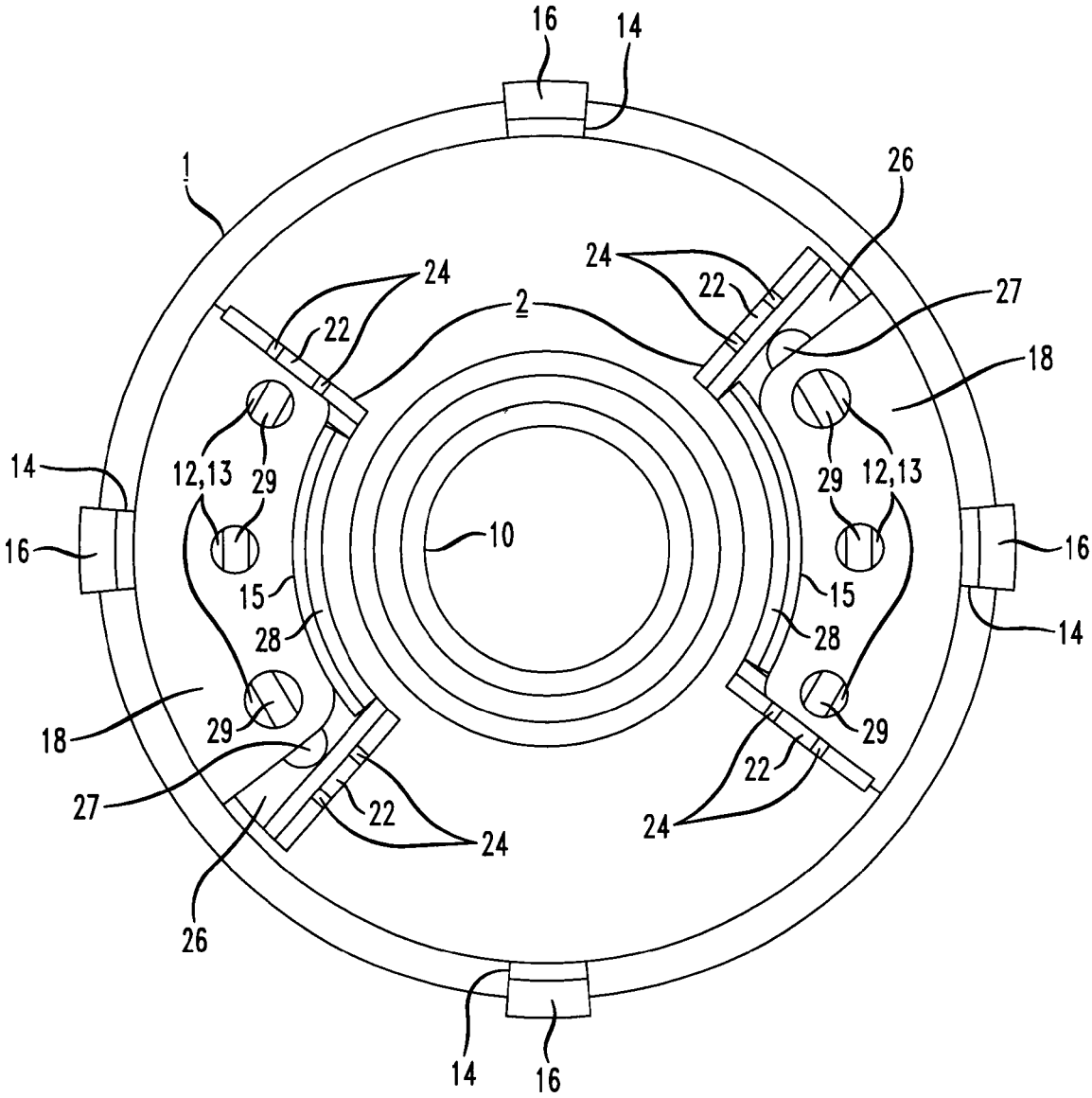
FIG. 8 is a diagram of yet another plan view of the cap and the twin terminals of the connector according to the present invention when they are in the fastened position.

FIG. 8 is a diagram of another perspective view of the connector according to the present invention in the non-aligned position. Referring to the figure, cap 1 is rotated to the non-aligned position such that keyhole tails 29 of twin terminals 2 are aligned with cap holes 12 and cap inside holes 13. In the aligned position, the insulated wires (not shown) pass through cap holes 12, keyhole round portions 27, and cap inside holes 13. During the transition from the aligned position to the non-aligned position, the insulation jacket of the insulated wires is removed and an electrical connection is effected between the electrical conductors of the insulated wires and twin terminals 2 by way of the metal keyholes 29.

Figure 9A:
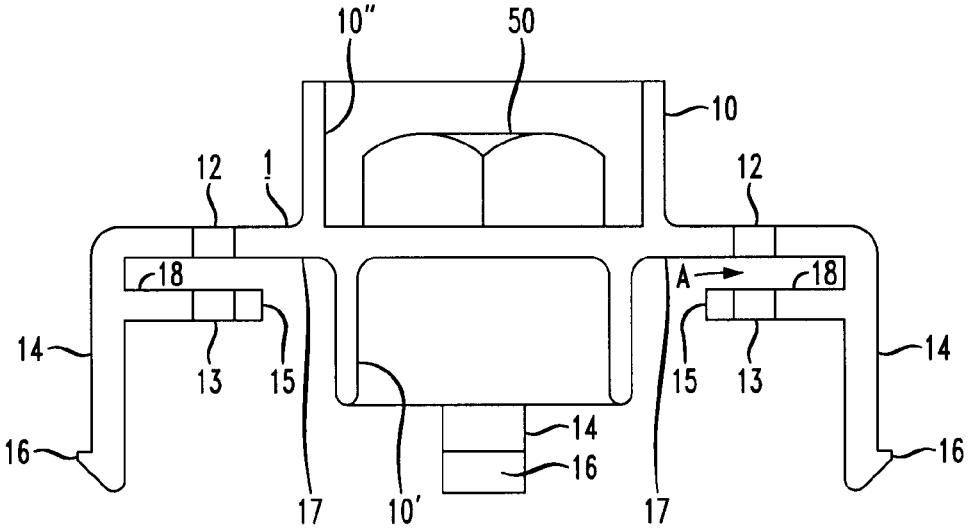
FIGS. 9A, 9B, and 9C are diagrams of cross-sectional views of the connector and its components according to the present invention.
Figure 9B:
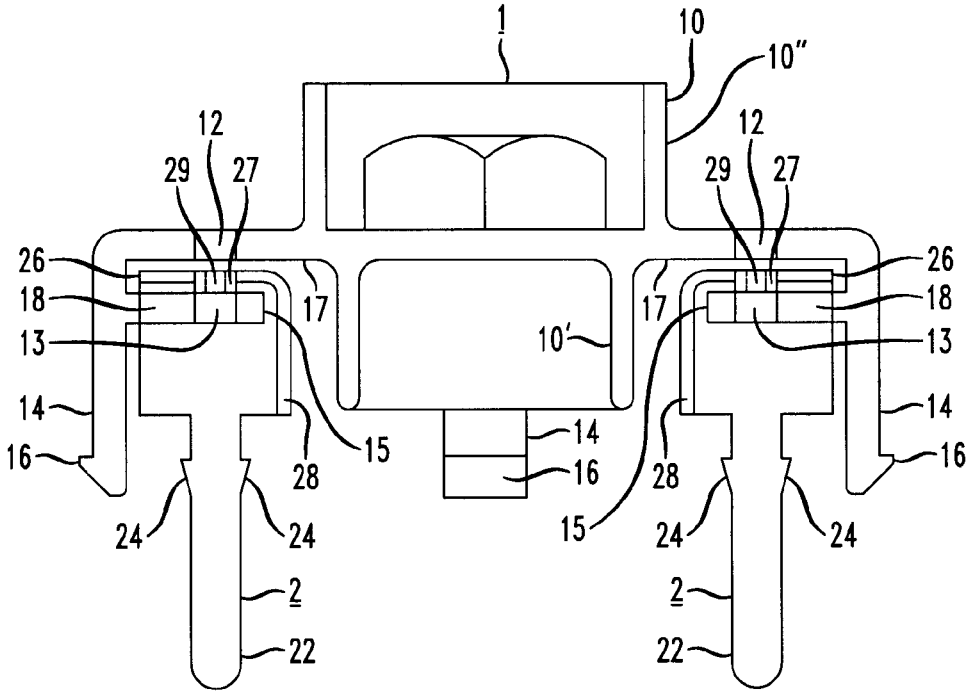
Figure 9C:
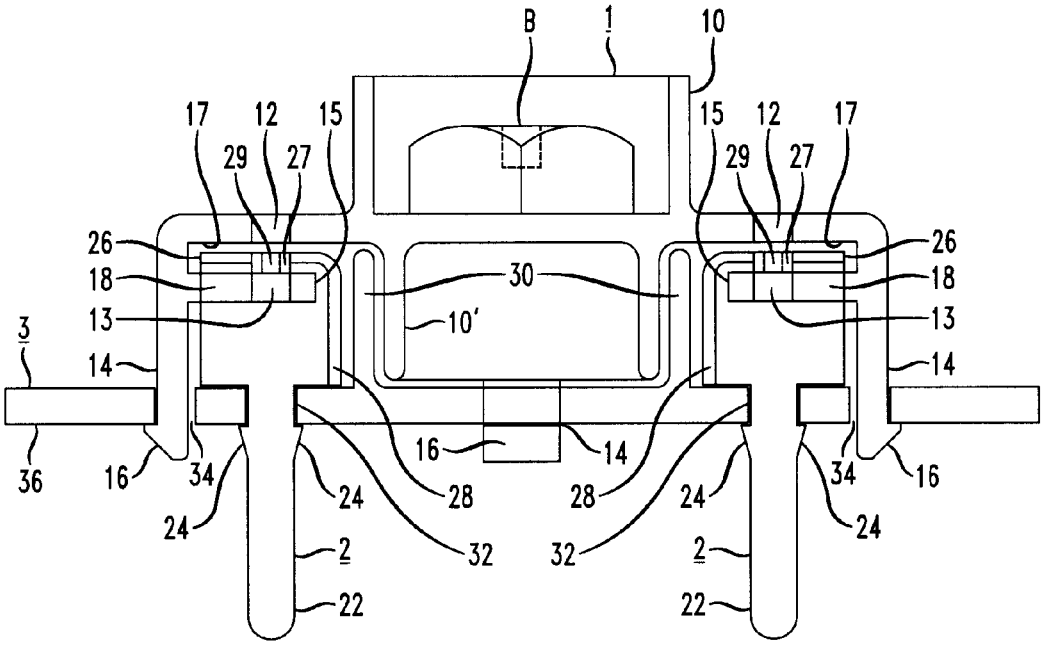

FIGS. 9A, 9B, and 9C are diagrams of cross-sectional views of the connector and its components according to the present invention. In particular, FIG. 9A illustrates the cross-sectional perspective of cap 1 of the connector according to the present invention. FIG. 9B illustrates the cross-sectional perspective of cap 1 and twin terminals 2 when they are fastened together. FIG. 9C illustrates the cross-sectional perspective of the connector when cap 1, twin terminals 2, and base 3 are pushed together to form a single mechanical unit.

Referring to FIG. 9A, cap 1 is dimensioned such that the space A between cap inside surface 17 and cap fins 18 will accommodate terminal top surface 26. By fitting terminal top 26 into that space A, twin terminals 2 are fastened with cap 1. Cap inside holes 13 on cap fins 18 are constructed to be aligned with cap holes 12. Cap 1 can be rotated by twisting cap notch 10".

In the present embodiment, cap notch 10 is a hexagonal socket head comprising a hexagonal head bolt 50 surrounded by the thin wall of notch portion 10". A user of the connector of the present invention can rotate cap 1 using a 7/16-inch, type 216 socket wrench, which is commercially available from Lucent Technologies, the assignee of the present invention. Cap notch 10 can alternatively include a screwdriver slit (single or cross, e.g. slit B of FIG. 9C), so that cap 1 can be rotated using a screwdriver. In addition, cap notch 10 can be a knob, a wing nut, a notch with a handle, or any device that a user can use to rotate cap 1.

FIG. 9B illustrates cap 1 and twin terminals 2 when they are fastened together. Referring to the figure, twin terminals 2 are fastened with cap 1 by fitting terminal top 26 into the space A between cap inside surface 17 and cap fins 18, with the terminal side wall 28 being disposed between cap notch portion 10' and cap fins 15. Cap fins 18 extend under terminal top surface 26 such that the cap inside holes 13 (which are aligned with cap holes 12) are aligned with keyhole round portions 27 in the aligned position (as shown in FIG. 7) or with the keyhole tails 29 in the non-aligned position (as shown in FIG. 8).

FIG. 9C illustrates the connector according to the present invention when cap 1, twin terminals 2 and base 3 are pushed together to form a single mechanical unit. Referring to the figure, cap 1 is fastened with base 3 by inserting cap hooks 14 into base grooves 34. Cap hooks 14 are retained by hooking cap hook protrusions 16 onto base bottom 36 of base 3 as noted above. Twin terminals 2 are fastened with base 3 by inserting L-shaped tails 22 into terminal slits 32. Twin terminals 2 are retained by hooking L-shaped tail protrusions 24 onto base bottom 36 as noted above. L-shaped tails 22 extend downward from terminal slits 32. Terminal top surface 26 and terminal side wall 28 of twin terminals 2 are disposed within cap 1 and base 3. In particular, terminal top surface 26 is disposed between cap fins 18 and cap inside surface 17. Base notch 30 is disposed between the lower portion 10' of cap notch 10, and terminal side wall 28, with terminal side wall 28 being disposed between base notch 30 and cap fin ends 15.

Base grooves 34 serve as the angular rotational stop for cap hooks 14. Thus, cap 1 can be rotated by twisting cap notch 10 to the aligned position, i.e., a point where cap hooks 14, along with cap hook protrusions 16, are stopped by base grooves 34. As cap 1 is rotated, the insulated wires placed in keyhole round portions 27 are engaged by keyhole tails 29 which cut into and remove the insulation jacket of the insulated wires (not shown), thereby effecting an electrical connection between the electrical conductors of the insulated wires and twin terminals 2 of the connector. Keyhole tails 29 of twin terminals 2 are adapted with particular widths to accommodate insulated wires of various gauges.

Figure 10:
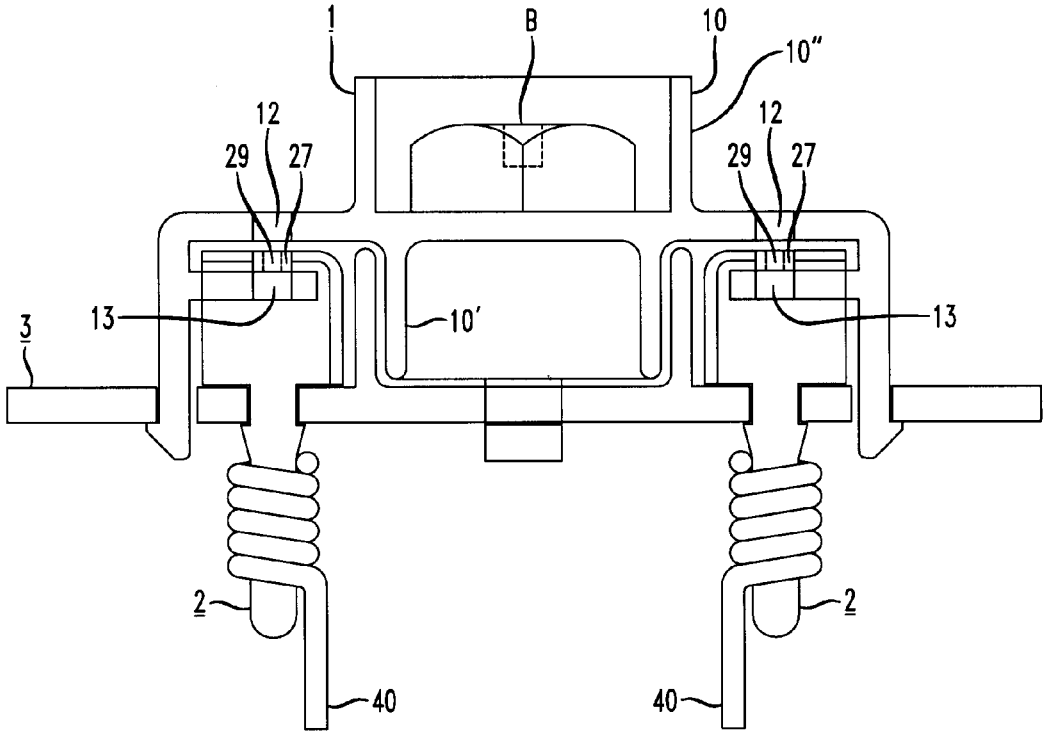
FIG. 10 is a diagram illustrating a cross-sectional view of the connector of the present invention in a wire wrap connection.

FIG. 10 is a diagram illustrating the connector according to the present invention in use for wire wrap connections with wire wraps 40. The wire wraps 40 are connected with the connector of the present invention by wrapping around twin terminals 2. Wire wraps 40 can be located around twin terminals 2 in a fast and convenient manner using wire wrap tools which are commercially available.

Once the unit is assembled, insulated wires may be placed into cap holes 12 on the top of the cap. They will extend through these holes and into cap inside holes 13 and terminal keyhole round portions 27, all of which are in the aligned position. As cap 1 is rotated by twisting cap notch 10 into the non-aligned position, the insulated wires placed in keyhole round portions 27 are engaged by keyhole tails 29 which cut into and remove the insulation jacket of the insulated wires (not shown) and the electrical conductors disposed therein are exposed. As a result, the electrical conductors make contact with twin terminals 2, which are made of conductive materials. Electrical connections are effected between the twin terminals 2 and wire wraps 40, either before or after the insulated wires are connected to the twin terminals by rotation of the cap 1.

Twin terminals 2 can electrically connect six insulated wires at (terminal top surface 26) and wire wrap two wires at L-shaped tails 22. Thus, the connector according to the present invention can advantageously effect an electrical connection for a plurality of insulated wires simultaneously to a single wire. However, the ratio of terminals to access holes for insulated wires can be much greater or less. Another advantage of the present invention is that the round design of cap 1 and the connector minimizes the materials needed for, and cost of, fabrication.

While the present invention has been particularly shown and described with reference to the preferred embodiments thereof, the embodiments are not intended to be exhaustive or to limit the present invention to the precise forms disclosed herein. It will be understood by those skilled in the art that various changes in form and detail may be made therein without departing from the spirit and scope of the present invention. Similarly, any process steps described may be interchangeable with other steps in order to achieve the same result. It is intended that the scope of the present invention is defined by the following claims and their equivalents.

I claim:

1. A connector for electrically connecting a plurality of wires and a plurality of insulated wires, each of the plurality of insulated wires having an insulation jacket and electrical conductors, wherein the electrical conductors are disposed at least partly in the insulation jacket, the connector comprising:

a cap with cap holes that allow the insulated wires to pass through;

at least one terminal made of electrically conductive material and having a tail capable of accommodating wire wrapping to which a further wire may be connected said terminal having a surface extending perpendicular to the tail and defining keyholes with round portions that may be aligned with the cap holes and allow the insulated wires to pass through, and a keyhole tail of narrower width than the round portions; and a base on which the terminal is securely fastened and on which the cap is fastened so that the cap may rotate between an aligned position in which the cap holes and the round portions of the terminal keyhole are aligned and a non-aligned position in which an insulated wire inserted into cap holes and round portions of the terminal keyhole is forced into the tail portion of the keyhole, the tail portion of the keyhole being formed such that it cuts and removes the insulated jacket from such a wire when it is forced therein and wherein the cap of the connector comprises a cap notch by which the cap can be rotated by twisting the cap notch, wherein the cap further comprises cap fins, the cap fins further comprising cap fin ends, and the terminal further comprising a concave-shaped terminal side wall disposed between the cap fin ends of the cap fins and a portion of the cap notch when the terminal is fastened with the cap.

2. The connector of claim 1 wherein said at least one terminal is twin terminals.

3. The connector of claim 1 wherein said other wire is a wire that is wire wrapped onto the tail of the terminal.

4. The connector of claim 1, wherein the keyhole tails of the keyholes of the twin terminals are dimensioned such that the keyhole tails allow the insulated wires to pass through without the insulation jackets.

5. The connector of claim 1, wherein the keyholes are dimensioned such that the keyholes allow insulated wires of various gauge sizes to pass through.

6. The connector of claim 1, wherein the cap notch is a hexagonal socket head, the hexagonal socket head comprising a hexagonal head bolt surrounded by a thin wall, whereby the cap of the connector can be rotated using a socket ranch.

7. The connector of claim 1, wherein the cap notch is a notch with a screwdriver slit, wherein the cap of the connector can be rotated using a screwdriver.

8. The connector of claim 1, wherein the cap notch is a notch with a handle, wherein the cap of the connector can be rotated by pushing the handle.

9. The connector of claim 1, the cap of the connector further comprising cap hooks extending from the cap and grooves in the base dimensioned so that said cap hooks engage said grooves and rotatably fasten the cap onto the base.

10. The connector of claim 9, wherein the cap hooks further comprise cap hook protrusions for hooking under the base of the connector.

11. The connector of claim 9, wherein the base grooves of the base of the connector are dimensioned such that the base grooves serve as rotational stops for the cap of the connector.

12. The connector of claim 1, wherein the cap of the connector further comprises cap fins attached to the cap receiving the terminal of the connector.

13. The connector of claim 12, wherein the cap of the connector further comprises a cap inside surface, and the terminal further comprises a terminal top surface, wherein a space is formed between the cap inside surface and the cap fins, such that the terminal is fastened with the cap by sliding the terminal top surface into the space.

14. A connector for electrically connecting a plurality of wires and a plurality of insulated wires, each of the plurality of insulated wires having an insulation jacket and electrical conductors, wherein the electrical conductors are disposed at least partly in the insulation jacket, the connector comprising:

a cap with cap holes that allow the insulated wires to pass through;

at least one terminal made of electrically conductive material and having a tail to which a further wire may be connected, said terminal having a surface extending perpendicular to the tail and defining keyholes with round portions that may be aligned with the cap holes and allow the insulated wires to pass through, and a keyhole tail of narrower width than the round portions; and a base on which the terminal is securely fastened and on which the cap is fastened so that it may rotate between an aligned position in which the cap holes and the round portions of the terminal keyhole are aligned and a non-aligned position in which an insulated wire inserted into cap holes and round portions of the terminal keyhole is forced into the tail portion of the keyhole, the tail portion of the keyhole being formed such that it cuts and removes the insulated jacket from such a wire when it is forced therein;

wherein the cap of the connector further comprises cap hooks extending from the cap and grooves in the base dimensioned so that said cap hooks engage said grooves and rotatably fasten the cap onto the base.

15. The connector of claim 14, wherein the cap hooks further comprise cap hook protrusions for hooking under the base of the connector.

16. The connector of claim 14, wherein the base grooves of the base of the connector are dimensioned such that the base grooves serve as rotational stops for the cap of the connector.

17. The connector of claim 14, wherein the cap of the connector comprises a cap notch, by which the cap can be rotated by twisting the cap notch, wherein the cap further comprises cap fins, the cap fins further comprising cap fin ends, and the terminal further comprising a concave-shaped terminal side wall disposed between the cap fin ends of the cap fins and a portion of the cap notch when the terminal is fastened with the cap.

18. A connector for electrically connecting a plurality of wires and a plurality of insulated wires, each of the plurality of insulated wires having an insulation jacket and electrical conductors, wherein the electrical conductors are disposed at least partly in the insulation jacket, the connector comprising:

a cap with cap holes that allow the insulated wires to pass through;

at least one terminal made of electrically conductive material and having a tail capable of accommodating a wire wrap connection and to which a further wire may be connected, said terminal having a surface extending perpendicular to the tail and defining keyholes with round portions that may be aligned with the cap holes and allow the insulated wires to pass through, and a keyhole tail of narrower width than the round portions; and a base on which the terminal is securely fastened and on which the cap is fastened so that the cap may rotate between an aligned position in which the cap holes and the round portions of the terminal keyhole are aligned and a non-aligned position in which an insulated wire inserted into cap holes and round portions of the terminal keyhole is forced into the tail portion of the keyhole, the tail portion of the keyhole being formed such that it cuts and removes the insulated jacket from such a wire when it is forced therein;

cap hooks and cap hook protrusions for hooking the cap hooks under the base of the connector.

19. The connector of claim 18, wherein base grooves of the base of the connector are dimensioned such that the base grooves serve as rotational stops for the cap of the connector.

20. The connector of claim 18, wherein the cap of the connector comprises a cap notch, by which the cap can be rotated by twisting the cap notch, wherein the cap further comprises cap fins, the cap fins further comprising cap fin ends, and the terminal further comprising a concave-shaped terminal side wall disposed between the cap fin ends of the cap fins and a portion of the cap notch when the terminal is fastened with the cap.

21. A connector for electrically connecting a plurality of wires and a plurality of insulated wires, each of the plurality of insulated wires having an insulation jacket and electrical conductors, wherein the electrical conductors are disposed at least partly in the insulation jacket, the connector comprising:

a cap with cap holes that allow the insulated wires to pass through;

at least one terminal made of electrically conductive material and having a tail to which a further wire may be connected, said terminal having a surface extending perpendicular to the tail and defining keyholes with round portions that may be aligned with the cap holes and allow the insulated wires to pass through, and a keyhole tail of narrower width than the round portions; and a base on which the terminal is securely fastened and on which the cap is fastened so that the cap may rotate between an aligned position in which the cap holes and the round portions of the terminal keyhole are aligned and a non-aligned position in which an insulated wire inserted into cap holes and round portions of the terminal keyhole is forced into the tail portion of the keyhole, the tail portion of the keyhole being formed such that it cuts and removes the insulated jacket from such a wire when it is forced therein;

cap hooks and cap hook protrusions for hooking the cap hooks under the base of the connector.

22. The connector of claim 21 wherein base grooves of the base of the connector are dimensioned such that the base grooves serve as rotational stops for the cap of the connector.

23. The connector of claim 21 wherein the cap of the connector comprises a cap notch, by which the cap can be rotated by twisting the cap notch, wherein the cap further comprises cap fins, the cap fins further comprising cap fin ends, and the terminal further comprising a concave-shaped terminal side wall disposed between the cap fin ends of the cap fins and a portion of the cap notch when the terminal is fastened with the cap.

* * * * *